US009581057B1

(12) United States Patent
Knezek et al.

(10) Patent No.: US 9,581,057 B1
(45) Date of Patent: Feb. 28, 2017

(54) VALVE ACTUATOR SYSTEM CAPABLE OF OPERATING MULTIPLE VALVES WITH A SINGLE CAM

(71) Applicant: AMERIBAND, LLC, Arlington, TX (US)

(72) Inventors: Robert A. Knezek, Arlington, TX (US); Michael J. Pastusek, Arlington, TX (US)

(73) Assignee: Ameriband, LLC, Arlington, TX (US)

( * ) Notice: Subject to any disclaimer, the term of this patent is extended or adjusted under 35 U.S.C. 154(b) by 0 days.

(21) Appl. No.: 14/831,848

(22) Filed: Aug. 20, 2015

Related U.S. Application Data

(60) Provisional application No. 62/039,815, filed on Aug. 20, 2014.

(51) Int. Cl.

| | |
|---|---|
| ***F01L 9/02*** | (2006.01) |
| ***F01L 1/047*** | (2006.01) |
| ***F01L 1/02*** | (2006.01) |
| ***F01L 1/14*** | (2006.01) |
| ***F01L 1/34*** | (2006.01) |

(52) U.S. Cl.
CPC ..... *F01L 9/02* (2013.01); *F01L 1/026* (2013.01); *F01L 1/047* (2013.01); *F01L 1/146* (2013.01); *F01L 1/34* (2013.01)

(58) Field of Classification Search
CPC ... F01L 9/02; F01L 9/023; F01L 9/021; F01L 1/34; F01L 1/352
See application file for complete search history.

(56) References Cited

U.S. PATENT DOCUMENTS

| | | | | |
|---|---|---|---|---|
| 1,788,609 A | | 1/1931 | Andrews | |
| 1,910,054 A | | 5/1933 | Rayburn | |
| 2,532,254 A | | 11/1950 | Gaston | |
| 2,788,777 A | * | 4/1957 | Clark | F01L 9/021 123/58.1 |
| 4,094,202 A | | 6/1978 | Kemper | |
| 4,100,815 A | | 7/1978 | Kemper | |
| 4,117,736 A | | 10/1978 | Kemper et al. | |
| 4,258,672 A | * | 3/1981 | Hietikko | F01L 13/0042 123/90.12 |
| 4,305,352 A | * | 12/1981 | Oshima | F01L 1/352 123/146.5 A |

(Continued)

FOREIGN PATENT DOCUMENTS

CN 101749122 A 6/2010

*Primary Examiner* — Zelalem Eshete
(74) *Attorney, Agent, or Firm* — Howison & Arnott, LLP

(57) ABSTRACT

A valve actuator system is capable of operating a number of valves with a single cam. The system includes a power shaft, a cam mounted around the power shaft and a gear train to drive the cam when the shaft rotates. Hydraulic actuator assemblies corresponding to the number of valves are radially positioned around the shaft axis for operation by the cam. Hydraulic tubes connect each actuator to a valve follower disposed adjacent to the respective valves. The cam profile pressing each actuator plunger in sequence as the cam rotates causes the hydraulic fluid to flow out of the actuator assembly, through the like-numbered pipe, and into the like-numbered follower assembly, which in turn causes the follower plunger to move the like-numbered valve from an open position or a closed position. This occurs sequentially for each valve.

11 Claims, 7 Drawing Sheets

(56) References Cited

U.S. PATENT DOCUMENTS

| | | | | |
|---|---|---|---|---|
| 4,433,596 | A | 2/1984 | Scalzo | |
| 4,497,284 | A | 2/1985 | Schramm | |
| 4,799,462 | A * | 1/1989 | Tittizer | F01L 9/021 123/90.12 |
| 5,513,553 | A | 5/1996 | Gleasman et al. | |
| 5,553,582 | A | 9/1996 | Speas | |
| 5,558,050 | A * | 9/1996 | Paro | F01L 9/021 123/90.13 |
| 5,782,219 | A | 7/1998 | Frey et al. | |
| 5,955,291 | A | 9/1999 | Alitalo et al. | |
| 6,397,794 | B1 | 6/2002 | Sanderson et al. | |
| 6,446,587 | B1 | 9/2002 | Sanderson et al. | |
| 6,460,450 | B1 | 10/2002 | Sanderson et al. | |
| 6,694,931 | B2 | 2/2004 | Palmer | |
| 6,829,978 | B2 | 12/2004 | Sanderson et al. | |
| 6,854,377 | B2 | 2/2005 | Sanderson et al. | |
| 6,883,416 | B2 | 4/2005 | Koelzer et al. | |
| 6,913,447 | B2 | 7/2005 | Fox et al. | |
| 6,915,765 | B1 | 7/2005 | Sanderson et al. | |
| 6,925,973 | B1 | 8/2005 | Sanderson et al. | |
| 6,968,751 | B2 | 11/2005 | Shulenberger et al. | |
| 7,007,589 | B1 | 3/2006 | Sanderson | |
| 7,011,469 | B2 | 3/2006 | Sanderson et al. | |
| 7,040,263 | B2 | 5/2006 | Sanderson et al. | |
| 7,140,343 | B2 | 11/2006 | Sanderson | |
| 7,153,105 | B2 | 12/2006 | Koelzer et al. | |
| 7,162,948 | B2 | 1/2007 | Sanderson et al. | |
| 7,185,578 | B2 | 3/2007 | Sanderson | |
| 7,270,092 | B2 | 9/2007 | Hefley | |
| 7,325,476 | B2 | 2/2008 | Sanderson | |
| 7,331,271 | B2 | 2/2008 | Sanderson et al. | |
| 7,334,548 | B2 | 2/2008 | Sanderson et al. | |
| 7,409,932 | B2 | 8/2008 | Gaiser | |
| 7,438,029 | B2 | 10/2008 | Fox et al. | |
| 2002/0157624 | A1 | 10/2002 | Janak | |
| 2007/0245992 | A1 | 10/2007 | Hefley | |
| 2009/0107327 | A1 | 4/2009 | Ota et al. | |
| 2010/0278463 | A1 | 11/2010 | Becker et al. | |
| 2012/0204825 | A1* | 8/2012 | Tolbert | F01L 9/021 123/90.16 |

* cited by examiner

VALVE ACTUATOR SYSTEM CAPABLE OF OPERATING MULTIPLE VALVES WITH A SINGLE CAM

CROSS-REFERENCE TO RELATED APPLICATIONS

This application claims the benefit of U.S. Provisional Application No. 62/039,815, filed on Aug. 20, 2014, entitled VALVE ACTUATOR SYSTEM CAPABLE OF OPERATING MULTIPLE VALVES WITH A SINGLE CAM, which is incorporated by reference herein in its entirety.

TECHNICAL FIELD

The present invention relates to a valve actuator system for an internal combustion piston engine. In particular, it relates to a valve actuator system that permits multiple valves to be operated by a single cam and can accommodate various piston arrangements and various engine firing orders.

BACKGROUND

Current engine designs such as those used in automotive and many other applications typically use an in-line or "V" arrangement of multiple pistons. Each intake and exhaust engine valve is opened and closed by a cam on one or more camshafts. Since each piston employs two or more valves, many cams are required for the engine. The camshafts are aligned parallel to the crankshaft that controls the oscillatory motion of the pistons. They extend approximately the entire length of the engine. The possible locations of the camshafts are limited due to the need to arrange them in concert with the valves they operate.

The arrangement of the camshafts is determined by the mechanical link between the cam and the valve the cam operates. The cam may operate directly on the valve, use a "push rod" and/or a "valve lifter" as a direct link between the cam and valve, or incorporate rocker arms to transfer the cam motion to the valve. A push rod is a small shaft that allows the cam and camshaft to be located some distance from the valve. A valve lifter is a small device that uses engine oil to maintain proper adjustment of the valve actuation mechanism. All of these options for valve actuation limit the practical locations for the cams and camshafts on the engine.

The rotation of each cam on each camshaft must be synchronized with the crankshaft in order for the valve to open and close at the proper position of the piston in the engine cycle. In four-stroke engines, the rotation of the camshaft is one-half as fast as the rotation of the crankshaft. Synchronization of the camshafts and crankshaft is accomplished in newer engines using timing belts or timing chains since the camshafts are often located too far from the crankshaft (for example, in the cylinder head) for them to be synchronized by gear arrangements alone. Timing belts can fail due to wear or breakage and require expensive replacement at specified intervals of operation.

SUMMARY

A first embodiment of the invention comprises a single cam, multiple valve actuators arranged radially about the cam, valve followers at each valve operated by the cam, and small tubes to transport hydraulic fluid as links between each actuator and the valve it operates. As the cam engages the valve actuator, a small piston in the actuator is displaced driving hydraulic fluid through the tube to the connected follower. Simultaneously a small piston in the valve follower is displaced to open the valve. After the cam high point passes the actuator piston, the actuator piston moves back to its starting point and the hydraulic fluid flows back into the valve actuator permitting the follower piston to return to its original position and the valve to close. The only fluid lost from the valve actuation system is any trivial seepage past the pistons. Any fluid lost is replaced by fluid from the hydraulic fluid source. This fluid source may be oil from the engine lubrication system.

The use of a hydraulic link between the actuator and the follower permits the valves and cam to be separated by a distance and location of the cam in an optimum place on the engine. This approach accommodates various cylinder arrangements and firing orders including ones that do not follow the traditional placement of cylinders in the "in line" or "V" configurations. The use of a hydraulic tube as the link between the cam location and valve location is similar to use of an electricity conducting wire as a link between a the spark generator in one location and a spark plug in another location.

The cam driving the actuators may be synchronized with the rotational component of the engine such as a crankshaft to open and close the valve at the appropriate phase of the engine combustion cycle. In typical four-cycle internal combustion engines, the cam rotates at one-half the rotational speed of the crankshaft. For example, the intake valve may open to allow air or a mixture of air and fuel to enter the combustion chamber and be closed the rest of the time. In another example, the exhaust valve may open to allow the products of combustion to exit the combustion chamber after the expansion cycle and be closed the rest of the time. Synchronization of the actuator and the engine may be accomplished by a mechanical interface. With the subject valve actuation system, one cam may be used to actuate all intake valves in a multi-cylinder engine and one cam used to actuate all exhaust valves.

If the actuator piston and the follower piston are the same size, the valve duplicates the action of the cam. If the pistons are not the same size, the valve action will be similar to that of the cam, but the follower action will either be amplified or reduced in comparison to the action of the cam.

A second embodiment includes followers for all intake or exhaust valves linked to an assembly consisting of one cam for all similar valves, and a set of reduction gears to synchronize the cams with a single power shaft that is rotationally connected to the crankshaft or its equivalent power shaft. Similarly, a second cam and set of reduction gears can be added to operate the other valves. The following example provides an illustration of the this embodiment based on an application to a 5-cylinder, four-stroke, piston engine with the cylinders arranged radially about a central power shaft and with the centerlines of the cylinders parallel to the centerline of the power shaft. The follower for each valve is linked with its actuator and a hydraulic fluid supply in the same manner as described for the first embodiment.

The configuration of the reduction gear set, cam, and actuators for the intake valves and the exhaust valves may be virtually mirror images of each other. A central camshaft that drives the two cams may be functionally fixed to the power shaft of the engine so that it rotates with a rotational speed proportional to the rotational speed of the power shaft. Each cam is connected to a set of planetary gears that reduce the rotational speed of the cam to one-half of the rotational speed of the central shaft. In this embodiment, the cam is part of the planetary gear carrier of its gear set. A single center (sun) gear mounted fixedly to the central shaft drives both sets of planetary gears and thereby each cam. The outside (ring) gear of each set is nominally fixed and does not rotate except to change valve timing. The proper relation of cam rotational speed and central shaft speed is obtained by proper ratio of size between the sun gear and the planetary gears. The ring gear is determined by the size of the sun gear and planetary gears.

A set of five actuators for one set of valves may be arranged radially about its cam. Similarly, a second set of actuators is arranged about the other cam. Each set of actuators is fastened to one of two parts of a housing that surrounds the central shaft. One part of the housing is held in place by fastening to a suitable structure such as a cylinder head. The central shaft extends through the housing and its rotation is fixed by the rotation of the engine power shaft. This housing also encases the reduction gears and cam for one set of valves. Part of the ring gear extends through the side of the housing. This part of the ring gear restrains the ring gear from rotating, but can be moved by the external device to change the timing of valves attached to the cam in this part of the housing. For demonstration purposes only, this set of valves may be selected as the intake valves.

The second set of actuators is mounted to the second part of the housing. The second part of the housing also surrounds the second set of reduction gears and cam. This part of the housing is similar to the first part except that it is mounted fixedly to the first part rather than to surrounding structure and the central shaft may not extend through the housing. When the housing is assembled, the arrangement of the gears, cam and actuators in the second part of the housing is virtually a mirror image of those in the first part of the housing except for the positions of the cams. The part of the ring gear extending from the ring gear of this set of gears permits the timing of the valves to be varied independently with respect to the timing of the valves operated by the cam in the first part of the housing. For demonstration purposes only, this set of valves may be selected as the exhaust valves.

The use of two sets of reduction gears in this configuration permits the independent variation of intake and exhaust valve timing. This capability is achieved with a nearly trivial increase of complexity when compared to a design without any variable valve timing. The simplicity is in stark contrast to the complexities in current engine designs.

All lubricating oil and leakage is directed through the bottom of the housing and back to the oil pan. The containment of engine oil makes it possible to keep the surrounding portion of the engine to be oil free and eliminates the need for oil containment covers as required in current engine designs.

The valve housing assembly, with or without the actuators attached, can be assembled and tested for correct timing prior to installation on an engine. This capability will simplify the engine assembly and maintenance process.

All of the features of this valve actuator assembly are accomplished without the need for timing belts, timing chains, or any other complex provisions.

A valve actuation system incorporating the above described features would be very difficult if not impossible using today's conventional technology. At least one camshaft would be required for each cylinder and independent variable valve timing would require added complexity.

A third embodiment is similar to the second except that each planetary gear reduction set that drives each cam is replaced by a linear set of reduction gears and the housing is modified to accommodate the difference in gear geometry A drive gear replaces the sun gear used in the planetary gear system used in the second embodiment. The drive gear is fixedly attached to the central shaft and rotates with it. The drive gear drives one side of a double gear (idler gear) that is mounted on a lever through a bearing. The idler gear is allowed to rotate about the bearing stem on the lever. The second side of the idler gear drives a cam gear fixedly attached to its cam. One end of the lever is mounted so that the lever is allowed to rotate about the camshaft. The other end of the lever is restrained to prevent rotation of the lever about the camshaft except to vary valve timing. The sizes of the drive gear, both sides of the idler gear, and the cam gear are selected to result in the desired rotational speed of the cam in relation to the rotational speed of the central shaft. When the rotational speed of the central shaft is equal to the rotational speed of the engine power shaft, this ratio is ½.

The following gear sizes are an example where the central camshaft is fixedly attached to the engine power shaft. The side of the double gear in contact with the drive gear is twice the size of the drive gear and rotates at half the rotational speed of the camshaft and in the opposite direction. A third gear is fixedly attached to the cam. The second side of the double gear meshes with the third gear. The second side of the double gear and the third gear are of the same size. This combination of gears results in the cam rotation in the same direction as the camshaft but at half the rotational speed as required for proper cam operation. Other combinations of gear sizes to produce the same gear reduction are possible.

The end of the lever opposite the camshaft is restrained from movement except to vary valve timing. Movement of this end of the lever for the intake valve cam varies timing of the intake valves. Similarly, movement of the same end of the lever for the exhaust valve cam varies timing of the exhaust valves.

Minor changes to the housing design in the second embodiment are made to accommodate replacement of the ring gear and planetary gears in the second embodiment with the lever and an idler gear in the third embodiment.

A fourth embodiment is similar to the second embodiment except that the planetary gears are used in a different way to achieve the desired rotational speed of the cams. Small changes in the housing design from the second embodiment are made to accommodate the differences in cam/gear interfaces and addition of bearings between the cams and the central shaft.

Each cam is fixedly attached to its ring gear or the two are made as one unit. The cam rotates with the same rotational speed as the ring gear. In this embodiment, there is no rotation of the planetary gear carrier except to change valve timing. This arrangement of fixed and rotating gears permits a greater range of valve timing than the configuration in the second embodiment.

In this embodiment, the cams rotate in the opposite direction from the central shaft. This difference is easily accommodated by rerouting the hydraulic line from each actuator to the proper valve. The cam rotational speed of one-half the rotational speed of the central shaft is accomplished when the diameter of the ring gear is twice that of the sun gear.

Other features of this embodiment are the same as those in the second embodiment.

BRIEF DESCRIPTION OF THE DRAWINGS

Reference is made to the following drawings for a more complete description of the four previously presented embodiments of the invention.

DETAILED DESCRIPTION

Figure 1:
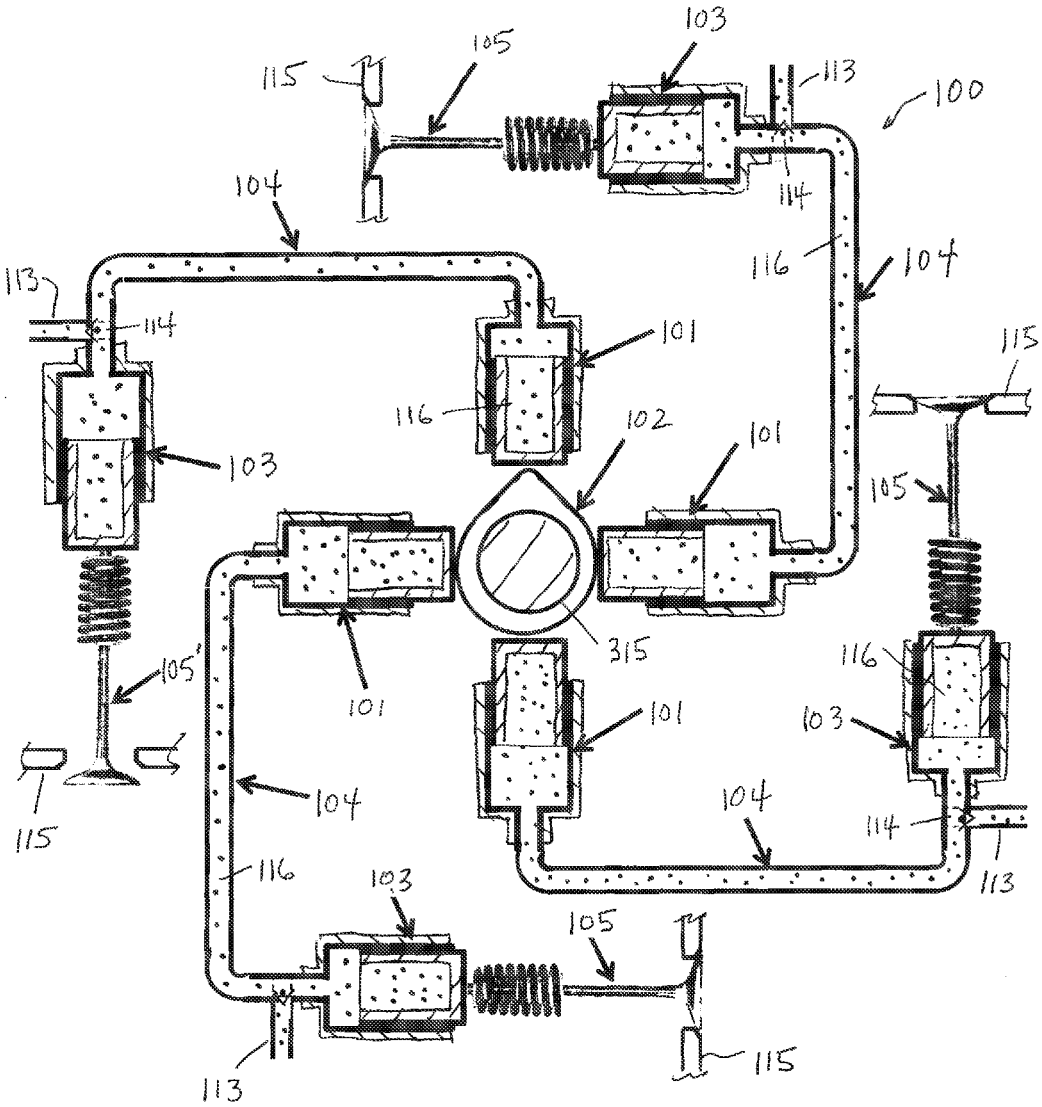
FIG. 1 is a schematic view of a valve actuator system in accordance with one aspect using a single cam to operate multiple valves.

Referring now to the drawings, wherein like reference numbers are used herein to designate like elements throughout, the various views and embodiments of a valve actuator system using a single cam to operate multiple valves are illustrated and described. Also other embodiments of this valve actuator system are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
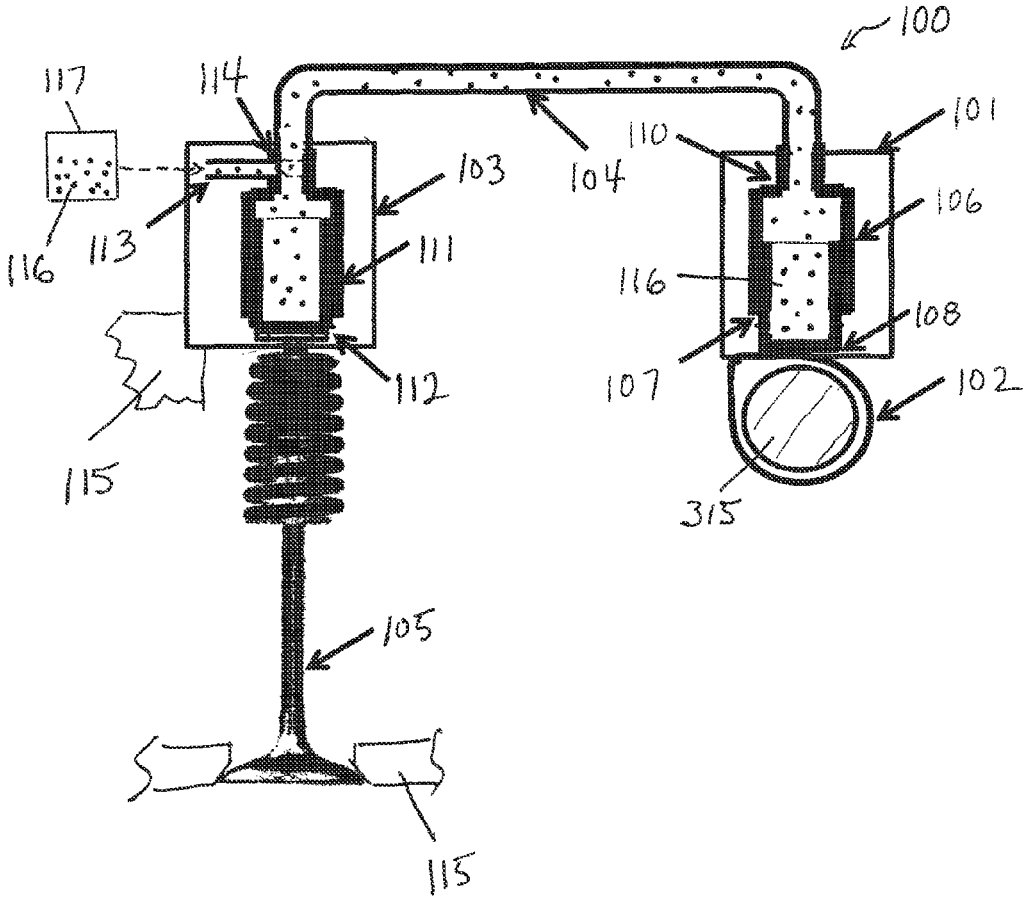
FIG. 2 is another schematic view, further illustrating components comprising the valve actuator system of FIG. 1.

Referring now to FIGS. 1 and 2, there is illustrated an exemplary embodiment of a valve actuator system 100 in accordance with one aspect. Referring first to FIG. 1, in the illustrated embodiment four valve actuators 101 are arranged radially about a single cam 102. Each actuator 101 is linked to its respective valve follower 103 by a small linking tube 104, all of which are filled with a hydraulic fluid 116. The follower 103 in turn causes the valve 105 to open and close in the same manner as the cam surface directs. Hydraulic fluid 116 (e.g., engine lubricating oil) transfers the force of the cam 102 from the actuator 101 to the follower 103 via the fluid-filled tube 104. In FIG. 1, one valve (denoted 105') is shown in the open position while all others are shown in the closed position. A more detailed description of the components and their operation is illustrated in FIG. 2.

Referring now also to FIG. 2, the cam 102 is connected to the engine crankshaft or other element (not shown) through a gear, belt, chain or other means so the cam causes the valve 105 to open and close in proper timing with the piston operation. In FIG. 2, the valve 105 is shown in the closed position. The actuator 101 comprises an actuator housing 106 that is mounted in a fixed position with relation to the cam 102. One open end 107 of the housing 106 permits a plunger 108 to slide back and forth as the cam 102 forces it to open the valve 105 or permits it to return to the closed position. The plunger 108 fits snugly within the actuator housing 106 to prevent hydraulic fluid 116 from leaking unnecessarily past the housing 106. The other end 110 of the actuator housing 106 connects with the linking tube 104. The tube 104, actuator 101 and follower 103 are filled with a hydraulic fluid 116.

Referring still to FIG. 2, the distant end of the linking tube 104 connects with the valve follower housing 111. The follower housing 111 is mounted in a fixed position in relation to the engine structure 115 around the valve 105. As the cam 102 pushes the actuator plunger 108 into the actuator housing 106, hydraulic fluid 116 is forced into the linking tube 104 and into the valve follower housing 111, forcing the valve plunger 112 to extend and open valve 105. The valve plunger 112 may be the same size as the actuator plunger 108 to replicate the motion produced by the cam 102, or it may be larger for less motion than the motion of actuator plunger 108, or it may be smaller to magnify the motion produced for actuator plunger 108 by the cam 102.

Hydraulic fluid 116 may be supplied to the valve actuator system 100 from a source 117, which may be the engine lubricating system, through supply tube 113. A check valve 114 permits flow of fluid into the valve actuation system 100, but it prevents fluid from being forced back into the fluid source 117 while the valve 105 is forced open. The hydraulic fluid supply pressure keeps the valve plunger 112 against the valve 105, and the cam plunger 108 against the cam 102. The supply pressure is kept lower than the pressure required to open the valve 105 so that the valve is only open when the cam 102 forces the cam plunger 108 into the actuator housing 106. There is essentially no flow of hydraulic fluid 116 from the system 100. This feature keeps power loss to a minimum. The hydraulic fluid supply 117 replaces any seepage around the actuator plunger 108 and the valve plunger 112. There is no fluid accumulator in the valve actuation system 100. The hydraulic fluid 116 simply flows from the actuator housing 106 to the follower housing 111 and back again.

Figure 3:
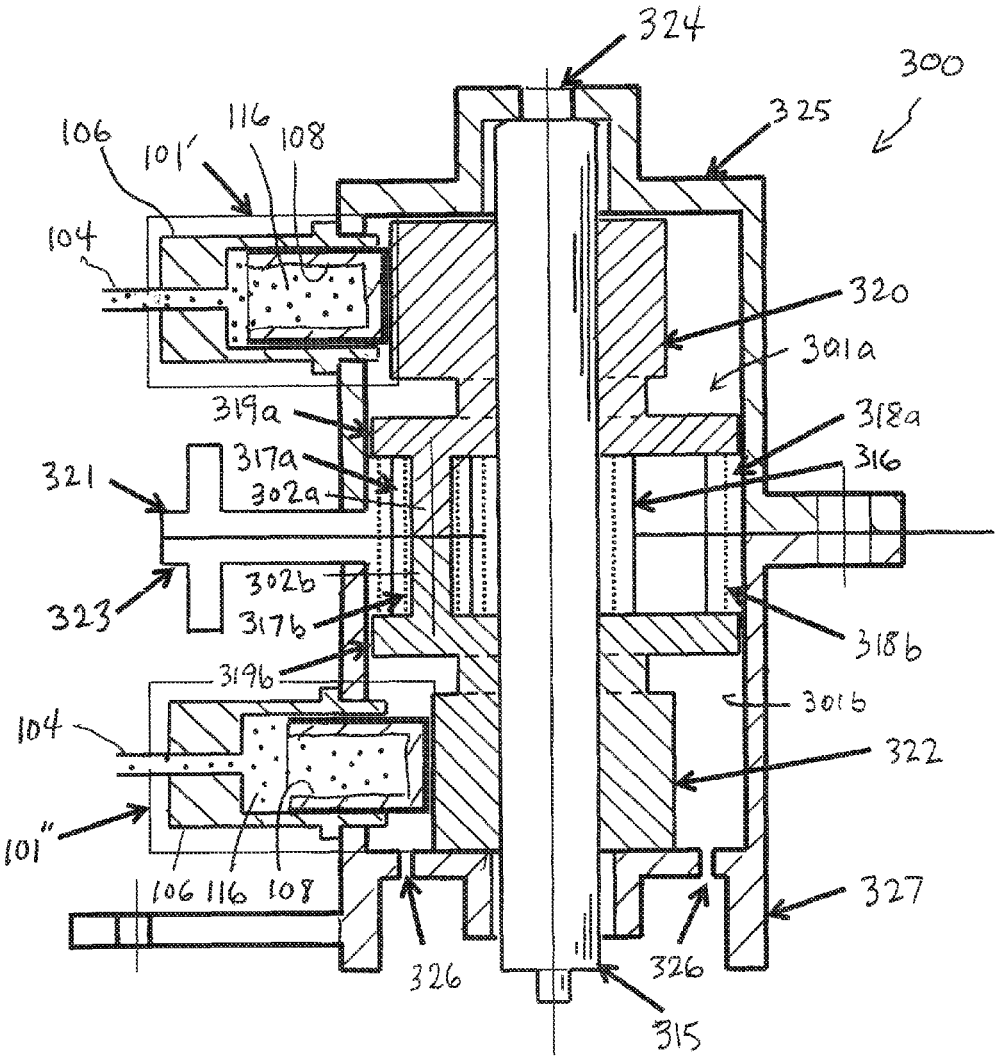
FIG. 3 is a cross-section side view of a valve actuator system in accordance with another aspect, wherein the system includes two cams and a set of planetary gears.

Referring now to FIG. 3, there is illustrated a cross-section side view of a valve actuator system 300 in accordance with another embodiment ("second embodiment"). The system 300 includes two cams, a first cam 320 for operating all exhaust valves and a second cam 322 for operating all intake valves, and two sets of planetary gears 301*a*, 301*b* for matching the operation of the respective cams with the rotation of the central power shaft of the engine. A central shaft 315 is connected rotationally in concert with the crankshaft (or power shaft) of the engine. A single sun gear 316 fixedly connected to the central shaft 315 drives two sets of planetary gears (denoted, respectively, with "a" and "b") to drive the exhaust and intake cams 320, 322 at the correct rotational speed. In this application, the ring gears 318*a*, 318*b* do not rotate except to vary valve timing.

Figure 4:
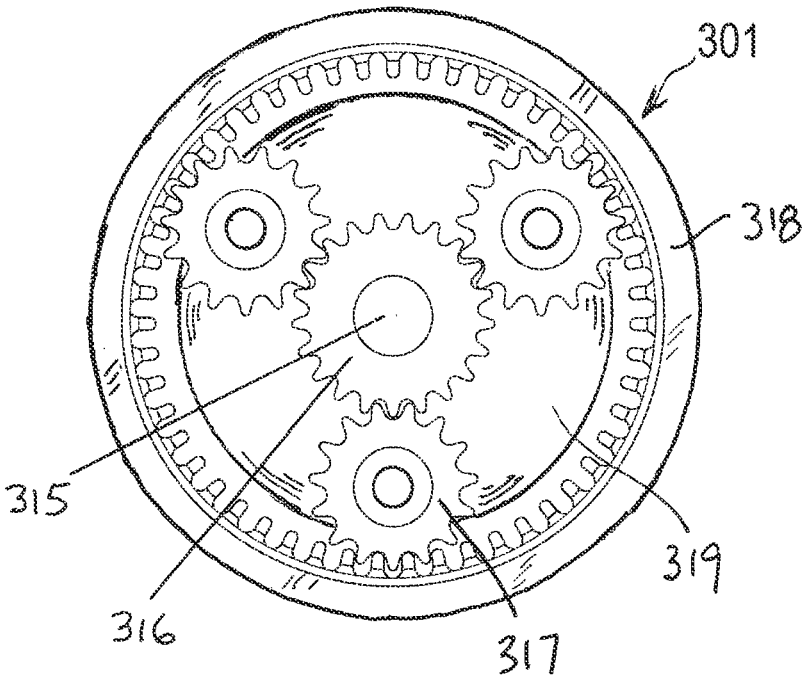
FIG. 4 is a top view showing the general arrangement of the components in a planetary gear reduction system in accordance with one embodiment.

Referring now to FIG. 4, a typical set 301 of planetary reduction gears is illustrated as may be used in the disclosed embodiments. In each set of planetary gears 301, a sun gear 316 on a shaft 315 is in geared engagement with a set of multiple (in this case, three) planetary gears 317 that are concurrently in geared engagement with an enclosing ring gear 318. The planetary gears 317 are rotatably attached through bearings to a carrier 319, which carrier may also be rotatable around the shaft 315. In various configurations, either the planet gears 317, the ring gear 318 or the planet carrier 319 may be constrained against rotation to produce a rotational output from the remaining components when driven by the sun gear 316. It will be appreciated that FIG. 4 is intended only to illustrate the general layout of a planetary gear set, and the particular gear sizes and gear ratios illustrated in FIG. 4 are not necessarily the gear sizes or gear ratios used in the embodiments described herein.

Returning to FIG. 3, a first set of gears, 317*a* and 318*a*, and a first carrier 319*a* are used to drive the exhaust cam 320 by the sun gear 316. In the illustrated embodiment, the exhaust cam 320 is fixedly mounted directly on the exhaust carrier 319*a*. Unlike the sun gear 316, which is fixed to the central shaft 315 to rotate with the central shaft, the exhaust carrier 319*a* and the exhaust cam 320 are rotatably mounted on the central shaft 315 to allow independent rotation with respect to the central shaft (although the carrier 319*a* and the cam 320 must rotate together). Each exhaust planet gear 317*a* is rotatably mounted on an axle bearing 302*a* of the exhaust carrier 319*a*, and is simultaneously engaged on the inward side by the sun gear 316 and on the outward side by the exhaust ring gear 318*a*. Relative rotational movement between the sun gear 316 and the ring gear 318*a* causes the planet gears 317*a* to simultaneously rotate on the axle bearing 302*a* of the carrier 319*a* and revolve around the sun gear. This revolution of the planet gears 317*a* causes the carrier 319*a* to rotate around the shaft 315. The sizes of the gears 317*a* and 318*a* are determined by the requirement for the exhaust cam 320 to rotate at half the rotational speed of the central shaft 315. The exhaust cam 320 is used to actuate all exhaust valves. Exhaust valve actuators 101' are arranged radially about the central shaft 315 and the exhaust cam 320. The exhaust actuator 101' shown in FIG. 3 is in the compressed state for an open exhaust valve 105. An exhaust timing lever 321 extends outward from the exhaust ring gear 318*a*, and may be used to selectively rotate the exhaust ring gear to vary the exhaust valve timing.

Referring still to FIG. 3, the component arrangement for operation of intake valves is similar to the one for operation of exhaust valves previously described. A second set of gears, 317*b* and 318*b*, and a second carrier 319*b* are used to drive the intake cam 322 by the sun gear 316. The intake cam 322 is fixedly mounted directly on the intake carrier 319*b*. The intake carrier 319*b* and the intake cam 322 are rotatably mounted on the central shaft 315 to allow independent rotation with respect to the central shaft (although the carrier 319*b* and the cam 322 must rotate together). The intake planet gear 317*b* is rotatably mounted on an axle bearing 302*b* of the intake carrier 319*b*, and is simultaneously engaged on the inward side by the sun gear 316 and on the outward side by the intake ring gear 318*b*. Relative rotational movement between the sun gear 316 and the intake ring gear 318*b* causes the intake planet gears 317*b* to simultaneously rotate on the axle bearing 302*b* of the intake carrier 319*b* and revolve around the sun gear. This revolution of the intake planet gears 317*b* causes the intake carrier 319*b* to rotate around the shaft 315. The sizes of the gears 317*b* and 318*b* are determined by the requirement for the intake cam 322 to rotate at half the rotational speed of the central shaft 315. The intake cam 322 is used to actuate all intake valves. Intake valve actuators 101" are arranged radially about the central shaft 315 and the intake cam 322. The intake valve actuator 101" shown in FIG. 3 is in the extended state indicating a closed intake valve 105. It should be noted that in the illustrated embodiment, the intake cam 322 leads the exhaust cam 320 by approximately 90 degrees. An intake timing lever 323 extends outward from the intake ring gear 318*b*, and may be used to vary intake valve timing (independently of the exhaust valve timing). The two timing levers 321, 323 are shown in the same position for illustration purposes only.

The valve actuator assembly 300 may include a housing fabricated in two parts, e.g., an upper housing 325 and a lower housing 327, to permit installation and orientation of components and verification of the configuration. In the illustrated embodiment, the respective actuator housings 106 of the intake valve actuator 101' and the exhaust valve actuator 101" are installed and oriented to the respective housing parts 325, 327 at fixed locations such that the outlet ports to the linking tubes 104 remain at respective fixed locations and respective fixed orientations relative to the housing 300. Hydraulic oil 116 may be provided through the fitting 324 in the upper housing 325 at the top of the central shaft 315 for lubrication of the components. It is anticipated that all hydraulic oil 116 including oil for lubrication and purging air bubbles will be returned to a collection system through openings 326 at the bottom of the lower housing 327. Similar provisions can be made with the follower installation.

Figure 5:
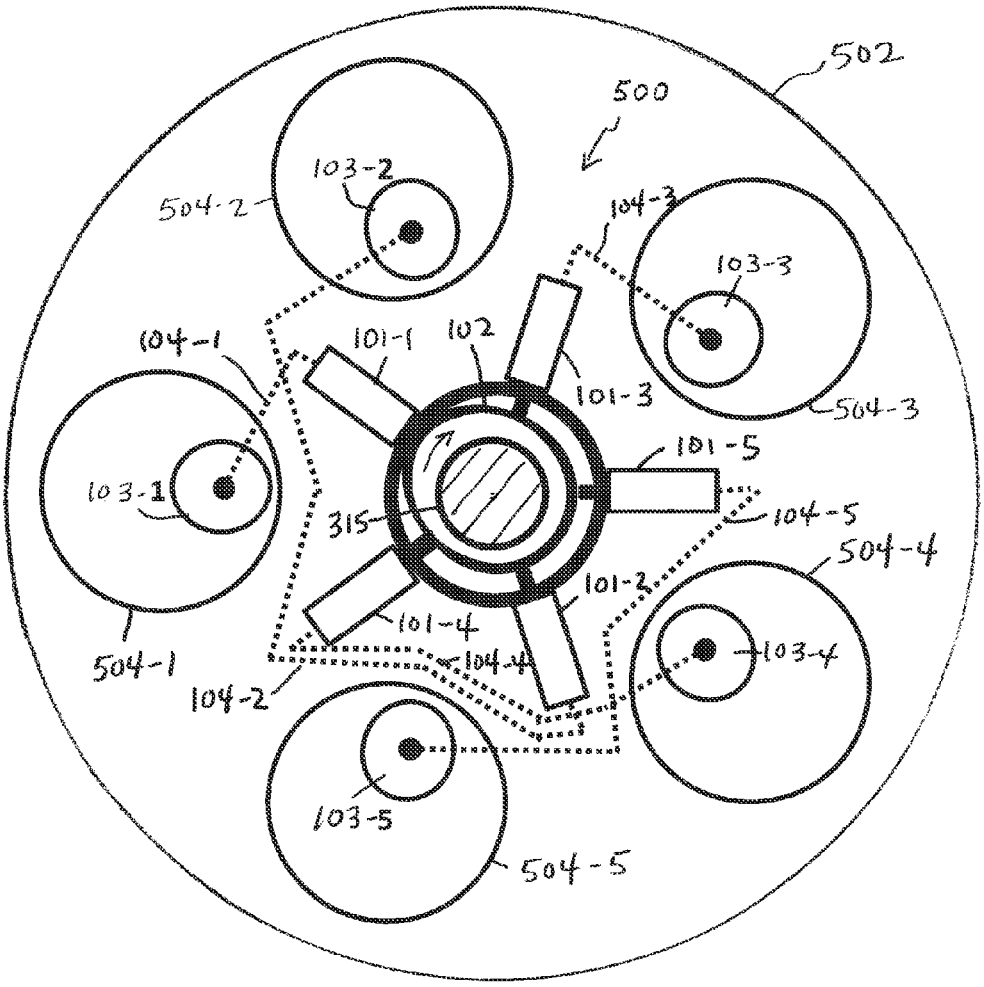
FIG. 5 is a schematic view showing the fluid lines connecting the cam actuators to the valve followers for all intake or exhaust valves in an engine configuration of five cylinders surrounding a central power shaft wherein the cylinder centerlines are parallel to the centerline of the power shaft in accordance with another embodiment.

Referring now to FIG. 5, a schematic diagram is provided of a valve actuator system 500 in accordance with another embodiment suitable for use on a four-cycle, five-cylinder piston engine 502 with the cylinders 504-*n* arranged radially around the central power shaft 315 that controls piston motion. For purposes of illustration, only one cam 102 is shown, and each cylinder 504-*n* is provided with only one valve follower 103-*n*, but it will be appreciated that multiple cams may be placed on the shaft as previously described (e.g., FIG. 3) to actuate multiple types of valves per cylinder. The cam 102 is operatively connected to the central power shaft 315 to rotate with the power shaft. The cylinders 504-*n* in this embodiment are sequentially numbered 504-1, 504-2, 504-3, 504-4 and 504-5 in clockwise order and the cam 102 also rotates clockwise. Each cylinder 504-*n* is provided with a corresponding valve follower 103-*n* to be actuated by the cam 102 in order to open a corresponding valve (not shown) on the cylinder. Valve actuators 101-*n* are arranged radially about the central shaft 315 and the cam 102. The dash-numbers on the valve actuators 101-*n* indicate the dash-number of the corresponding valve follower 103-*n* to which that the respective valve actuator 101-*n* is linked (e.g., actuator 101-1 is linked to follower 103-1, actuator 101-2 is linked to follower 103-2, etc.). The firing order for this arrangement is (1), (3), (5), (2), (4). The dashed lines 104-*n* indicate the corresponding hydraulic tube connections between the respective valve actuators 101-*n* and the corresponding valve followers 103-*n*. The particular routes shown for the hydraulic lines 104-*n* are for illustration only; however, the interconnections are specific.

Valve actuation systems incorporating an integrated reduction gear set and multiple cam actuators with one or two cams as described in these embodiments can be expected to offer significant advantages over the current technology. Independent intake and exhaust valve timing are easily achieved. Such valve actuation systems can be designed, constructed and installed as a single unit in various locations and orientations. In many installations, the installation should be able to avoid the use of timing belts and timing chains with their risk of failure and requirements for replacement. Such valve actuation systems do not require lengthy camshafts with multiple cams and their location requirements; thereby freeing up design features not available in current technology engines. Such valve actuation systems can be especially advantageous with non-traditional cylinder arrangements, such as those illustrated in FIG. 5. Achieving an oil-free upper cylinder head will simplify the installation of spark plugs and their wiring. It avoids the problem of oil leaks that now occur with valve covers.

Figure 6:
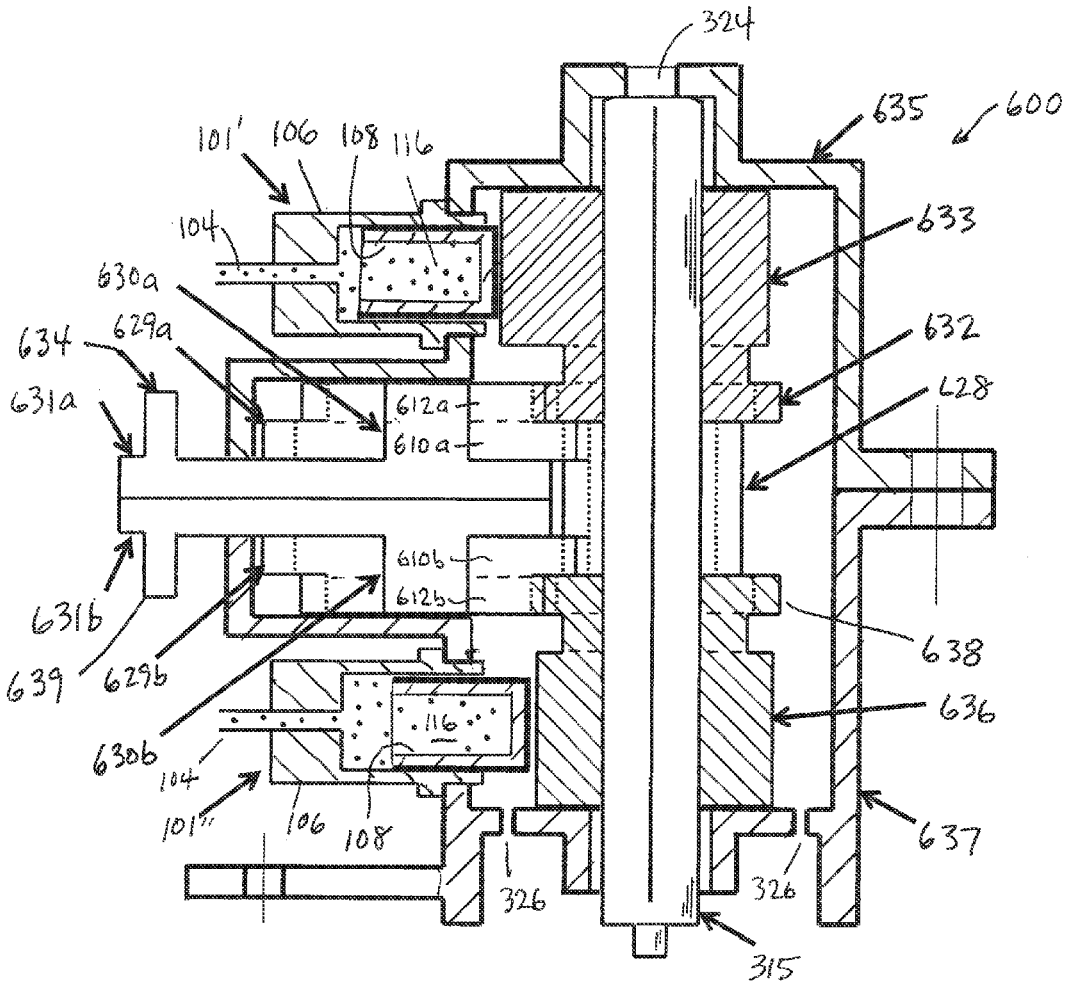
FIG. 6 is a cross-section side view of a valve actuator system in accordance with yet another aspect, wherein the system includes two cams and a set of linear reduction gears.

Referring now to FIG. 6, there is illustrated a valve actuation system 600 in accordance with another embodiment ("third embodiment"). Valve action system 600 is similar to the system 300 previously described, except that each set of planetary reduction gears 301 is replaced by a set of double idler gears mounted on a lever. The assembly housing 635, 637 is also modified to accommodate the different gear arrangement. If multiple cams are required, then separate gear trains may be provided for each cam, but all cams may be driven by the same power shaft.

In the illustrated embodiment, two cams 633 and 636 are provided, the cams being driven, respectively, by an "a" gear train and a "b" gear train. In this embodiment, the sun gear 316 of FIG. 3 is replaced by a central drive gear 628 that drives both gear trains. The central drive gear 628 is fixed to the power shaft 315 and rotates with it. The "a" gear train includes a two-part idler gear 629*a* having two coaxial gear portions, a larger portion 610*a* and a smaller portion 612*a*, wherein each portion has a different diameter. The larger gear portion 610*a* of the idler gear 629*a* engages the central drive gear 628 and rotates about the bearing 630*a* on an exhaust timing lever 631*a*. The number of teeth on the larger portion 610*a* of the idler gear 629*a* is twice the number of the teeth on the drive gear 628, resulting in a 2:1 gear ratio. Thus, the idler gear 629*a* rotates at half the rotational speed but in opposite directions as the drive gear 628 and the central shaft 315. The smaller portion 612*a* of the idler gear 629*a* engages the gear section 632 of the exhaust cam 633. The exhaust cam 633 rotates freely about the central shaft 315. The smaller portion 612*a* of the idler gear 629*a* and the gear section 632 have the same number of teeth, resulting in a 1:1 gear ratio, so that both rotate at the same rotational speed but in opposite directions. The result is that the exhaust cam 633 rotates around the central shaft 315 in the same direction that the central shaft rotates, but at one-half the rotational speed.

During operation of the "a" gear train, the exhaust timing lever 631*a* is normally held in a fixed position; however, the timing lever can be moved in an arc around the central shaft 315 to vary the exhaust valve timing. In the illustrated embodiment, one end portion of the timing lever 631*a* (e.g., the right end portion in FIG. 6) is constrained by the upper housing 635 (constraint not visible) to rotate about the central shaft 315. An exhaust timing actuator connection 634 extends from the other end of the timing lever 631*a*, and the gear bearing 630*a* is mounted on the timing lever between the two ends. To vary the exhaust timing, the timing lever 631*a* may be selectively rotated about the central shaft 315 by moving the timing actuator connection 634 in an arc. This arcing movement of the timing lever 631*a* causes the position of gear bearing 630*a* (upon which the idler gear 629*a* is mounted) to move in a similar arc about the central shaft 315 (while the idler gear stays in engagement with the central drive gear 628 and the gear section 632), thereby advancing or retarding the relationship between the angular position of the exhaust cam 633 and the angular position of the central drive gear 628 and power shaft 315 to adjust the exhaust timing.

Gear components of the "b" gear train (denoted with "b") that drive the intake cam 636 may be substantially similar to the parts used to drive the exhaust cam 633. In some embodiments, the intake cam 636 may be identical to the intake cam 633, but in other embodiments it may be modified to better meet the requirements of intake valves as opposed to those of exhaust valves. The "b" gear train includes a two-part idler gear 629*b* having two coaxial gear portions, a larger portion 610*b* and a smaller portion 612*b*, wherein each portion has a different diameter. The idler gear 629*b* may be identical to the idler gear 629*a*, but this is not required, provided each gear produces the appropriate gear ratios. The larger gear portion 610*b* of the idler gear 629*b* engages the central drive gear 628 and rotates about the bearing 630*b* on an intake timing lever 631*b*. The number of teeth on the larger portion 610*b* of the idler gear 629*b* is twice the number of the teeth on the drive gear 628, resulting in a 2:1 gear ratio. Thus, the idler gear 629*b* rotates at half the rotational speed but in opposite directions as the drive gear 628 and the central shaft 315. The smaller portion 612*b* of the idler gear 629*b* engages the gear section 638 of the intake cam 636. The intake cam 636 rotates freely about the central shaft 315. The smaller portion 612*b* of the idler gear 629*b* and the gear section 638 have the same number of teeth, resulting in a 1:1 gear ratio, so that both rotate at the same rotational speed but in opposite directions. The result is that the intake cam 636 rotates around the central shaft 315 in the same direction that the central shaft rotates, but at one-half the rotational speed.

During operation of the "b" gear train, the intake timing lever 631*b* is normally held in a fixed position; however, the timing lever can be moved in an arc around the central shaft 315 to vary the exhaust valve timing. In the illustrated embodiment, one end portion of the timing lever 631*b* (e.g., the right end portion in FIG. 6) is constrained by the lower housing 637 (constraint not visible) to rotate about the central shaft 315. An intake timing actuator connection 639 extends from the other end of the timing lever 631*b*, and the gear bearing 630*b* is mounted on the timing lever between the two ends. To vary the intake timing, the timing lever 631*b* may be selectively rotated about the central shaft 315 by moving the timing actuator connection 639 in an arc. This arcing movement of the timing lever 63*b* causes the position of gear bearing 630*b* (upon which the idler gear 629*b* is mounted) to move in a similar arc about the central shaft 315 (while the idler gear stays in engagement with the central drive gear 628 and the gear section 638), thereby advancing or retarding the relationship between the angular position of the intake cam 636 and the angular position of the central drive gear 628 and power shaft 315 to adjust the intake timing. It will be appreciated that this arrangement allows the exhaust valve timing and the intake valve timing to be adjusted independently of one another.

Figure 7:
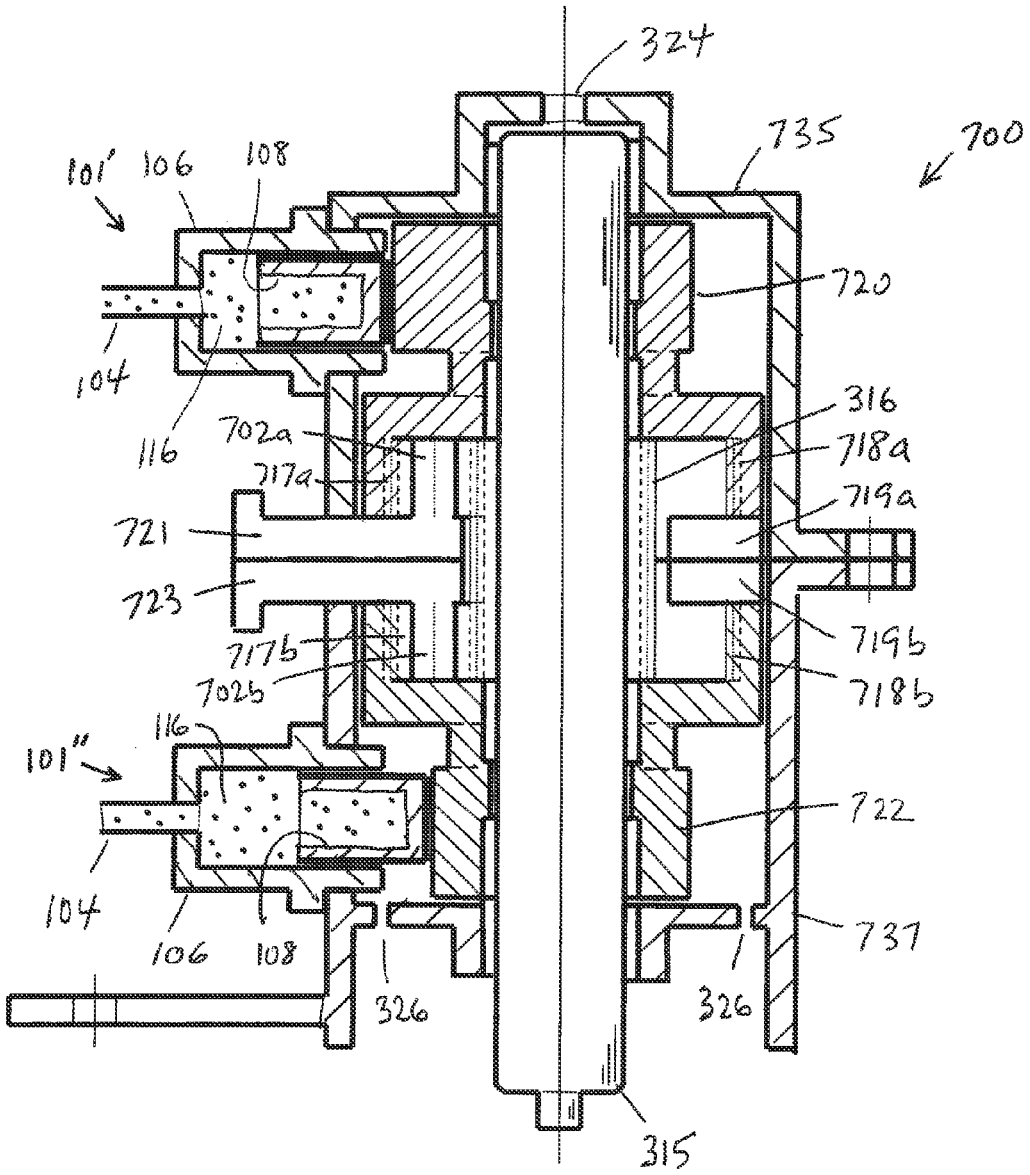
FIG. 7 is a cross-section side view of a valve actuator system in accordance with a further aspect, wherein the system includes two cams and an alternative set of planetary gears having a different arrangement from that shown in FIG. 3.

Referring now to FIG. 7, there is illustrated a valve actuation system 700 in accordance with yet another embodiment ("fourth embodiment"). The embodiment of FIG. 7 is substantially similar to the embodiment of FIG. 3 ("second embodiment") except that the planetary gear set uses a different configuration to achieve the desired rotational speed of the cams. In particular, in this fourth embodiment the ring gears rotate continuously and there is no rotation of the planetary gear carrier except to change valve timing, whereas in the second embodiment of FIG. 3 the planetary gear carrier rotates continuously and there is no rotation of the ring gear except to change valve timing. This arrangement of fixed and rotating gears may permit a greater range of valve timing than the configuration in the second embodiment. Changes in the upper and lower housing 735, 737 from the second embodiment are also made to accommodate the differences in cam/gear interfaces and addition of bearings between the cams and the central shaft.

In the valve actuation system 700, the exhaust cam 720 and the intake cam 722 are driven by separate gear trains (denoted "a" and "b") similar to those previously described. A sun gear 316 is fixed to a central shaft 315 to rotate with the central shaft. The sun gear 316 engages a plurality of planet gears 717*a* and 717*b* from both gear trains. The planet gears 717*a* are rotatably mounted on axle bearings 702*a* of a first planetary gear carrier 719*a*, and the planet gears 717*b* are rotatably mounted on axle bearing 702*b* of a second planetary gear carrier 719*b*. An exhaust timing lever 721 extends from the planetary gear carrier 719*a*, and an intake timing lever 723 extends from the planetary gear carrier 719*b*. The timing levers 721, 723 prevent the rotation of the respective planetary gear carriers 719*a*, 719*b* except to change valve timing as further described herein.

Each cam 720, 722 is fixedly attached to a respective ring gear 718*a*, 718*b*. In some embodiments, each cam and its respective ring gear are separately formed pieces connected together, whereas in other embodiments the two elements may be formed integrally as a single piece. Each cam 720, 722 and its connected ring gear 718*a*, 718*b* are rotatably mounted on the central shaft 315 to allow independent rotation with respect to the central shaft (although each cam/ring gear pair 720/718*a* and 722/718*b* must rotate together). Thus, each cam 720, 722 rotates with the same rotational speed as its respective ring gear 718*a*, 718*b*.

The planet gears 717*a* engage the sun gear 316 on one side and the ring gear 718*a* on the other side. Since the planet gear carrier 719*a* is constrained from free rotation by the exhaust timing lever 721, then rotation of the sun gear 316 drives rotation of the ring gear 718*a*, and hence rotation of the exhaust cam 720. The sizes of the gears 717*a* and 718*a* are determined by the requirement for the exhaust cam 720 to rotate at half the rotational speed of the central shaft 315. Similarly, the planet gears 717*b* engage the sun gear 316 on one side and the ring gear 718*b* on the other side. Since the planet gear carrier 719*b* is constrained from free rotation by the intake timing lever 723, then rotation of the sun gear 316 drives rotation of the ring gear 718*b*, and hence rotation of the intake cam 722. The sizes of the gears 717*b* and 718*b* are determined by the requirement for the exhaust cam 722 to rotate at half the rotational speed of the central shaft 315.

The exhaust cam 720 may be used to actuate all exhaust valves (not shown). Exhaust valve actuators 101' may be arranged radially about the central shaft 315 and the exhaust cam 720. The exhaust timing lever 721 may be moved in an arc around the shaft 315 to vary the exhaust valve timing in a manner substantially similar to that described in connection with the second embodiment and with FIG. 6 ("third embodiment"). Similarly, the intake cam 722 may be used to actuate all intake valves (not shown). Intake valve actuators 101" may be arranged radially about the central shaft 315 and the intake cam 722. The intake timing lever 723 may be moved in an arc around the shaft 315 to vary the intake valve timing.

In the illustrated embodiment of FIG. 7, the cams 720, 722 rotate in the opposite direction from the central shaft 315 and sun gear 316. This directional difference is easily accommodated by rerouting the hydraulic lines 104-*n* (FIG. 5) from each actuator 101-*n* to the proper valve follower 103-*n*. A cam rotational speed of one-half the rotational speed of the central shaft 315 is accomplished when the diameter of the ring gears 718*a*, 718*b* is twice that of the sun gear 316.

It will be appreciated by those skilled in the art having the benefit of this disclosure that valve actuator systems in accordance with the aspects and embodiments described herein may operate multiple valves with a single cam. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A valve actuator system capable of operating a number of spring-biased valves of a first type with a single cam, the number of first-type valves being two or more, each first-type valve being assigned a number from an operating sequence and being movable between a closed position and an open position, the valve actuator system comprising:

a power shaft rotatably mounted in a frame and defining a shaft axis;

a first cam rotatably mounted around the power shaft for coaxial rotation relative to the power shaft about the shaft axis, the first cam having a surface defining a first cam profile extending radially from the shaft axis;

a first gear train operatively engaged between the power shaft and the first cam to rotationally drive the first cam relative to the power shaft when the power shaft rotates, the first gear train having a gear ratio $R_1$ not equal to 1 such that when the power shaft rotates at a first rotational speed $S_S$, the first cam rotates coaxially about the power shaft at a second rotational speed $S_{C1}=S_S/R_1$;

two or more first-type actuator assemblies corresponding in number to the number of first-type valves to be operated, each actuator assembly being assigned a respective number from an operating sequence and the actuator assemblies being disposed in a radial arrangement around the first cam in order according to the respective assigned operating sequence numbers, each first-type actuator assembly including an actuator housing defining a bore, an internal cavity holding a total volume of a hydraulic fluid, and an outlet port in fluid communication with the internal cavity, an actuator plunger slidably mounted in the bore of the actuator housing such that movement of the actuator plunger relative to the actuator housing will vary the total volume of the hydraulic fluid within the bore and internal cavity causing the hydraulic fluid to flow into or out of the internal cavity;

the first-type actuator assemblies being radially positioned relative to the shaft axis such that the first cam profile sequentially presses and releases each actuator plunger as the cam rotates, and the respective actuator housings of the first-type actuator assemblies being connected to the frame such that the respective outlet ports remain at respective fixed locations and respective fixed orientations relative to the frame;

two or more linking tubes corresponding in number to the number of first-type valves to be operated, each linking tube being assigned a respective number from the operating sequence, each respective linking tube being connected at a first end to the outlet port of the like-numbered first-type actuator assembly and having a second end in hydraulic communication with the first end;

two or more first-type valve follower assemblies corresponding in number to the number of first-type valves to be operated, each follower assembly being assigned a respective number from the operating sequence, each respective valve follower being disposed adjacent to the like-numbered first-type valve to be moved between a closed position and an open position and each first-type valve follower assembly including a follower housing defining a bore, an internal cavity holding a total volume of the hydraulic fluid, and an inlet port in fluid communication with the internal cavity, the inlet port being in fluid connection with second end of the like-numbered linking tube, a follower plunger slidably mounted in the bore of the follower housing such that varying the total volume of hydraulic fluid within the bore and internal cavity will move the follower plunger against the like-numbered valve, and wherein the cam profile pressing each respective actuator plunger as the cam rotates relative to the power shaft causes the hydraulic fluid to flow out of the actuator assembly, through the like-numbered linking pipe, and into the like-numbered follower assembly, which in turn causes the follower plunger to move the like-numbered first-type valve from a first one of an open position or a closed position to the other of the open position of the closed position; and wherein the cam profile subsequently releasing each respective actuator plunger as the cam rotates relative to the power shaft causes the hydraulic fluid to flow out of the like-numbered follower assembly, through the like-numbered linking pipe, and back into the actuator assembly, which in turn causes the follower plunger to move the like-numbered first-type valve back to its previous position.

2. A valve actuator system in accordance with claim 1, wherein the first gear train is a planetary gear set further comprising:

a sun gear fixedly mounted on the power shaft to rotate with the power shaft at a first rotational speed in common with the power shaft;

a ring gear mounted in the frame around the power shaft to be coaxial with the shaft axis;

a planet gear carrier mounted in the frame to be rotatable about the shaft axis; and a plurality of planet gears rotatably mounted on the planet gear carrier, each planet gear simultaneously rotationally engaging the sun gear and the ring gear;

wherein the first cam is fixedly mounted to the planet gear carrier to rotate with the planet gear carrier at a second rotational speed in common with the planet gear carrier; and wherein rotating the power shaft at the first rotational speed rotates the first cam at the second rotational speed, the second rotational speed being less that the first rotational speed, to sequentially actuate the first-type valves in accordance with the operational sequence.

3. A valve actuator system in accordance with claim 2, wherein the ring gear is constrained by the frame to move in an arc around the power shaft, and the system further comprises:

a first timing lever extending from the ring gear that can rotate the ring gear about the power shaft axis;

wherein fixing the position of the timing lever causes the valve actuator system to operate with constant valve timing for the first-type valves; and wherein moving the timing lever in an arc around the power shaft axis varies the valve timing of the first-type valves without changing the location and orientation of the outlet ports of the actuator housings with respect to the frame.

4. A valve actuator system in accordance with claim 1, wherein the first gear train is a planetary gear set further comprising:

a sun gear fixedly mounted on the power shaft to rotate with the power shaft at a first rotational speed in common with the power shaft;

a ring gear mounted in the frame around the power shaft to be rotatable about the shaft axis;

a planet gear carrier mounted in the frame to be coaxial with the shaft axis; and a plurality of planet gears rotatably mounted on the planet gear carrier, each planet gear simultaneously rotationally engaging the sun gear and the ring gear;

wherein the first cam is fixedly mounted to the ring gear to rotate with the ring gear at a second rotational speed in common with the ring gear; and wherein rotating the power shaft at the first rotational speed rotates the first cam at the second rotational speed, the second rotational speed being less that the first rotational speed, to sequentially actuate the first-type valves in accordance with the operational sequence.

5. A valve actuator system in accordance with claim 4, wherein the planet gear carrier is constrained by the frame to move in an arc around the power shaft, and the system further comprises:

a first timing lever extending from the planet gear carrier that can rotate the planet gear carrier about the power shaft axis;

wherein fixing the position of the timing lever causes the valve actuator system to operate with constant valve timing for the first-type valves; and wherein moving the timing lever in an arc around the power shaft axis varies the valve timing of the first-type valves without changing the location and orientation of the outlet ports of the actuator housings with respect to the frame.

6. A valve actuator system in accordance with claim 1, wherein the first gear train is a linear gear set further comprising:

a central gear fixedly mounted on the power shaft to rotate with the power shaft at a first rotational speed in common with the power shaft;

an idler gear rotationally mounted on a bearing to rotate about an axis parallel to the shaft axis, the idler gear including a large portion rotationally engaged with the central gear to rotate at a second rotational speed when driven by rotation of the central gear, and a small portion connected to, and rotating with, the large portion at the second rotational speed;

a cam gear section rotatably mounted over the power shaft to be rotatable relative to the power shaft about the shaft axis, the cam gear section being rotationally engaged with the small portion of the idler gear to rotate at a third rotational speed when driven by rotation of the small portion; and the first cam being fixedly connected to the cam gear section to rotate with the cam gear section about the shaft axis at the third rotational speed in common with the cam gear section, and wherein rotating the power shaft at the first rotational speed rotates the first cam at the third rotational speed, the third rotational speed being less that the first rotational speed, to sequentially actuate the first-type valves in accordance with the operational sequence.

7. A valve actuator system in accordance with claim 6, wherein the idler gear bearing is mounted to a timing lever that is constrained by the frame to move in an arc around the power shaft axis, and wherein fixing the position of the timing lever causes the valve actuator system to operate with constant valve timing for the first-type valves and moving the timing lever in an arc around the power shaft axis varies the valve timing of the first-type valves without changing the location and orientation of the outlet ports of the actuator housings with respect to the frame.

8. A valve actuator system in accordance with claim 1, further comprising:

a second cam rotatably mounted around the power shaft for coaxial rotation relative to the power shaft about the shaft axis, the second cam having a surface defining a second cam profile extending radially from the shaft axis;

a second gear train operatively engaged between the power shaft and the second cam to rotationally drive the second cam relative to the power shaft when the power shaft rotates, the second gear train having a gear ratio $R_2$ not equal to 1 such that when the power shaft rotates at the first rotational speed $S_S$, the second cam rotates coaxially about the power shaft at a second rotational speed $S_{C2}=S_S/R_2$;

two or more second-type actuator assemblies corresponding in number to a number of second-type valves to be operated, each actuator assembly being assigned a respective number from the operating sequence and the actuator assemblies being disposed in a radial arrangement around the second cam in order according to the respective assigned operating sequence numbers, the second-type actuator assemblies being radially positioned relative to the shaft axis such that the second cam profile sequentially presses and releases each actuator plunger as the second cam rotates;

two or more linking tubes corresponding in number to the number of second-type valves to be operated, each linking tube being assigned a respective number from the operating sequence, each respective linking tube being connected at a first end to the outlet port of the like-numbered second-type actuator assembly and having a second end in hydraulic communication with the first end;

two or more second-type valve follower assemblies corresponding in number to the number of second-type valves to be operated, each follower assembly being assigned a respective number from the operating sequence, each respective valve follower being disposed adjacent to the like-numbered second-type valve to be moved between a closed position and an open position;

wherein the second cam profile pressing each respective second-type actuator plunger as the second cam rotates relative to the power shaft causes the hydraulic fluid to flow out of the actuator assembly, through the like-numbered linking pipe, and into the like-numbered follower assembly, which in turn causes the follower plunger to move the like-numbered second-type valve from a first one of an open position or a closed position to the other of the open position of the closed position; and wherein the second cam profile subsequently releasing each respective actuator plunger as the second cam rotates relative to the power shaft causes the hydraulic fluid to flow out of the like-numbered follower assembly, through the like-numbered linking pipe, and back into the actuator assembly, which in turn causes the follower plunger to move the like-numbered second-type valve back to its previous position.

9. A valve actuator system for an engine having multiple cylinders, each cylinder having an exhaust valve and an intake valve, the actuator system capable of operating multiple exhaust valves with a single exhaust cam and multiple intake valves with a single intake cam, the cylinders being assigned a number from an operating sequence, the valve actuator system comprising:

a power shaft rotatably mounted in a frame and defining a shaft axis;

an exhaust cam rotatably mounted around the power shaft for coaxial rotation relative to the power shaft about the shaft axis, the exhaust cam having a surface defining an exhaust cam profile extending radially from the shaft axis;

a first gear train operatively engaged between the power shaft and the exhaust cam to rotationally drive the exhaust cam relative to the power shaft when the power shaft rotates, the first gear train having a gear ratio $R_1$ not equal to 1 such that when the power shaft rotates at a first rotational speed $S_S$, the exhaust cam rotates coaxially about the power shaft at a second rotational speed $S_C=S_S/R_1$;

a first plurality of hydraulic actuator assemblies corresponding in number to the number of cylinders, each actuator assembly being assigned a respective number from an operating sequence and the actuator assemblies being disposed in a radial arrangement around the exhaust cam in order according to the respective assigned operating sequence numbers;

a first plurality of linking tubes corresponding in number to the number of cylinders, each linking tube being assigned a respective number from the operating sequence, each respective linking tube being connected at a first end to the like-numbered exhaust actuator assembly and having a second end in hydraulic communication with the first end;

a first plurality of hydraulic valve follower assemblies corresponding in number to the number of cylinders, each follower assembly being assigned a respective number from the operating sequence, each respective valve follower being disposed adjacent to the like-numbered exhaust valve to be moved between a closed position and an open position and each valve follower assembly being in fluid connection with second end of the like-numbered linking tube;

an intake cam rotatably mounted around the power shaft for coaxial rotation relative to the power shaft about the shaft axis, the intake cam having a surface defining an intake cam profile extending radially from the shaft axis;

a second gear train operatively engaged between the power shaft and the intake cam to rotationally drive the intake cam relative to the power shaft when the power shaft rotates, the second gear train having a gear ratio $R_2$ not equal to 1 such that when the power shaft rotates at the first rotational speed $S_S$, the intake cam rotates coaxially about the power shaft at a second rotational speed $S_{C2}=S_S/R_2$;

a second plurality of hydraulic actuator assemblies corresponding in number to the number of cylinders, each actuator assembly being assigned a respective number from an operating sequence and the actuator assemblies being disposed in a radial arrangement around the intake cam in order according to the respective assigned operating sequence numbers;

a second plurality of linking tubes corresponding in number to the number of cylinders, each linking tube being assigned a respective number from the operating sequence, each respective linking tube being connected at a first end to the like-numbered intake actuator assembly and having a second end in hydraulic communication with the first end;

a second plurality of hydraulic valve follower assemblies corresponding in number to the number of cylinders, each follower assembly being assigned a respective number from the operating sequence, each respective valve follower being disposed adjacent to the like-numbered exhaust valve to be moved between a closed position and an open position and each valve follower assembly being in fluid connection with second end of the like-numbered linking tube;

wherein the exhaust and intake cam profiles sequentially activate each respective actuator as the respective cam rotates, thereby causing the hydraulic fluid to flow out of the respective actuator assembly, through the respective like-numbered linking pipe, and into the respective like-numbered follower assembly, which in turn causes the respective follower to move the respective like-numbered exhaust or intake valve from a first one of an open position or a closed position to the other of the open position of the closed position.

10. A valve actuator system for an engine in accordance with claim 9, wherein:

the first gear train is a planetary gear set further comprising a sun gear fixedly mounted on the power shaft to rotate with the power shaft;

a first ring gear mounted in the frame around the power shaft to be coaxial with the shaft axis;

a first planet gear carrier mounted in the frame to be rotatable about the shaft axis; and a first plurality of planet gears rotatably mounted on the first planet gear carrier, each first planet gear simultaneously rotationally engaging the sun gear and the first ring gear;

wherein the exhaust cam is fixedly mounted to the first planet gear carrier to rotate with the first planet gear carrier; and the second gear train is a planetary gear set further comprising the sun gear fixedly mounted on the power shaft;

a second ring gear mounted in the frame around the power shaft to be coaxial with the shaft axis;

a second planet gear carrier mounted in the frame to be rotatable about the shaft axis; and a second plurality of planet gears rotatably mounted on the second planet gear carrier, each second planet gear simultaneously rotationally engaging the sun gear and the second ring gear;

wherein the intake cam is fixedly mounted to the second planet gear carrier to rotate with the second planet gear carrier.

11. A valve actuator system for an engine in accordance with claim 10, wherein:

the first ring gear is constrained by the frame to move in an arc around the power shaft, the second ring gear is constrained by the frame to move in an arc around the power shaft, and the system further comprises a first timing lever extending from the first ring gear that can rotate the first ring gear about the shaft axis; and a second timing lever extending from the second ring gear that can rotate the second ring gear about the shaft axis;

wherein moving the first timing lever in a first arc around the shaft axis varies the valve timing of the exhaust valves;

wherein moving the second timing lever in a second arc around the shaft axis varies the valve timing of the intake valves; and the valve timing of the exhaust valves may be varied independently from the valve timing of the intake valves.

* * * * *